US005945147A

United States Patent [19]

Borchard

[11] Patent Number: 5,945,147

[45] Date of Patent: Aug. 31, 1999

[54] METHOD FOR PACKAGING FRESH PERISHABLE FOODS

[75] Inventor: James A. Borchard, Encintas, Calif.

[73] Assignee: Cold-bag, Inc., Encinitas, Calif.

[21] Appl. No.: 08/956,803

[22] Filed: Oct. 23, 1997

[51] Int. Cl.[6] ..... B65B 55/00

[52] U.S. Cl. ..... 426/393; 426/395; 426/396; 426/415; 426/418; 53/419; 53/434; 53/447

[58] Field of Search ..... 426/393, 395, 426/396, 418, 324, 333, 331, 415; 53/434, 447, 469, 479, 512, 531, 419

[56] References Cited

U.S. PATENT DOCUMENTS

| | | | |
|---|---|---|---|
| 4,055,931 | 11/1977 | Myers | 53/22 B |
| 4,821,489 | 4/1989 | MacLeod et al. | 53/419 |
| 5,014,495 | 5/1991 | Bolejack et al. | 53/433 |
| 5,312,034 | 5/1994 | Nakagawa et al. | 229/120 |
| 5,458,899 | 10/1995 | Floyd et al. | 426/404 |
| 5,565,230 | 10/1996 | Bailey | 426/411 |
| 5,660,512 | 8/1997 | Elze et al. | 410/124 |
| 5,738,890 | 4/1998 | Candiente et al. | 426/106 |

*Primary Examiner*—Nina Bhat
*Attorney, Agent, or Firm*—Pretty, Schroeder & Poplawski

[57] ABSTRACT

A method of packaging perishable foods wherein the perishable food product is packed in a plurality of cartons and the cartons are stacked on a pallet for storage and/or transportation, including placing a sheet of material on a pallet to provide a bottom sheet, with the bottom sheet overhanging the sides of the pallet, stacking a plurality of cartons on the bottom sheet on the pallet to form a carton stack, covering the top and sides of the carton stack with a bag of a gas permeable material, the bag having a closed top and an open bottom with a lower edge, sealing the edges of the bottom sheet to the lower edge of the bag, introducing a quantity of nitrogen gas through an opening into the interior of the bag without withdrawing any gas from the bag, and sealing the opening to retain the nitrogen within the bag, and apparatus for packaging such perishable products. Preferably the gas permeable material is a selective permeable material which is more permeable to oxygen than to nitrogen.

16 Claims, 5 Drawing Sheets

27
27'
60
60'
25
25'
44
44'
45
43
42
24
24'
49
48
50
51
52
53
54
55
56
57
58
SOLENOID SWITCH VALVE
SOLENOID SWITCH VALVE
PRESSURE REGULATOR VALVE
MANUAL BYPASS VALVE
TANK SELECTOR VALVE
GAS TANK
GAS TANK
NOZZLE SELECTOR SWITCH
INDICATOR LIGHT
TIMER
REMOTE POWER SWITCH
POWER SWITCH
POWER INDICATOR LIGHT
DC POWER INVERTER
POWER SWITCH
5 MINUTE MECHANICAL TIMER
BATTERY
AC POWER

METHOD FOR PACKAGING FRESH PERISHABLE FOODS

BACKGROUND OF THE INVENTION

This invention relates to the preservation of fresh produce, and more specifically to methods and apparatus for packaging perishable fruits such as strawberries. The invention preserves and protects fresh fruit during storage and shipment from the cooling facility to the distant marketplaces through the world.

Strawberries are picked in the fields and placed into a small plastic container, some of which have foldable lids, while others are open faced. These containers typically are about 4"×4" or 5"×7". The plurality of the packed containers are placed into open faced cartons which are stacked onto a pallet for transportation of the containers of fresh produce.

The produce is brought from the field to a cooling facility where the entire pallet of strawberries is brought down to a temperature no less than about 33 degrees Fahrenheit and no more than about 40 degrees Fahrenheit, preferably 34 degrees F.

Often for distant markets, the stacks of cartons is wrapped in some form of flexible material. Typically, this flexible packing material is sealed around the stack of cartons. In a presently used system, the interior of the package is exhausted with a vacuum, and recharged with carbon dioxide gas. A variety of packaging methods and equipment are reported. In another reported system the interior of the package is flushed with a gas under pressure, such as a nitrogen rich gas, or may be exhausted with a vacuum. If a vacuum has been used, the interior typically may be charged with carbon monoxide, carbon dioxide, oxygen and mixtures thereof.

There are many disadvantages to the system that is currently in use. Number one, the systems used today are inefficient. Secondly, carbon dioxide gas is not the ideal gas to be used for this process. Last of all, the packaging film used does not perform as needed for quality assurance.

First, the systems used are not economically nor ergonomically efficient. With most systems, there is a designated room or wide area within the cooling facility to operate the large, stationary machine used in the process. This is valuable, cooled space that could be used for holding/storing produce awaiting transit. Next, the process of packaging the stack of cartons involves an excessive amount of labor, time, and equipment. After the stack of cartons has been covered, an operator must transport the package from a holding room to the designated area with a forklift. Another operator, then seals, exhausts, and recharges the package with the machine. After which, the package is picked up again with the forklift and taken back to the holding facility or loaded onto a waiting truck. The entire system and process can be made much more efficient by implementing a much smaller machine that is portable throughout the cooling facility, and eliminating the steps of moving the package to another room for the gas process and returning the package to the holding room.

Secondly, carbon dioxide is not necessarily the "ideal gas" for preserving strawberries. CO2 gas alters the taste of the fruit and is too permeable to the package that holds it. The process that is used today exhausts the package of oxygen and replenishes it with carbon dioxide as a preservative gas. When fruit is starved of oxygen it begins to ferment, giving off acetaldehyde, ethanol, and ethyl acetate, in turn altering the taste. CO2 is also 16/1 times more permeable to polyethylene film than nitrogen, meaning that when placed into the package, the gas quickly escapes. In a short time, excessive CO2 can absorb into the fruit creating a "fizzy" taste in the strawberry, different from the fermented taste. Also, when CO2 is injected into the stack of cartons it leaves an oil residue on the produce, which affects the skin of the fruit and again the taste. CO2 does preserve the fruit from gray mold, a bacteria that feeds on oxygen, but in the process of which it is used, it alters the fruit's taste before it reaches the consumer in the marketplace.

Next, there are problems with the flexible material that is used. The material presently used is too thin to provide an insulation barrier significant enough to protect the perishable fruit from exposure to the elements, such as fluctuating temperatures while loading or unloading or within the transport trailer, and wind chill caused by refrigeration units. The material is also not strong enough to endure chafing amongst packages causing the seal of the package to fail. Finally, the low density polyethylene film (LDPE) is not as effective as other materials available, in controlling the permeability of the gases within the package to those which are in the atmosphere.

Some more sophisticated systems regularly or continuously measure one or more characteristics of the gas, and change the gas content to maintain a desired gas condition. Such systems are used on large sea containers and air cargo containers. The expense of the metering devices needed make these systems unsatisfactory for produce moving from the field to the retail store in this country.

Accordingly, it is an object of the present invention to provide a new and improved method and apparatus for overcoming these disadvantages.

Other objects, advantages, features and results will more fully appear in the course of the following description.

SUMMARY OF THE INVENTION

In the method of packaging perishable foods of the invention the perishable food product is packed in a plurality of cartons and the cartons are stacked on a pallet for storage and/or transportation, a sheet of material is placed on a pallet to provide a bottom sheet, with the bottom sheet extending beyond the sides of the stack, a plurality of the cartons are stacked on the bottom sheet on the pallet to form a carton stack, the top and sides of the carton stack are covered with a bag of a gas permeable material, the bag having a closed top and an open bottom with a lower edge, the edges of the bottom sheet are sealed to the lower edge of the bag, a quantity of nitrogen gas is introduced through an opening into the interior of the bag without withdrawing any gas from the bag, and the opening is sealed to retain the nitrogen within the bag.

The apparatus of the invention for packaging perishable food products which are packed in a plurality of cartons for stacking on a pallet includes a sheet of a material of a size to overly a pallet and provide a bottom sheet with edges extending beyond the sides of the stack, a bag of a size to position over a stack of cartons, with the bag having a closed top and an open bottom edge and being of a gas permeable material, means for sealing the overhanging portions of the bottom sheet and the edge of the bag together to form a sealed enclosure for the stack of cartons, means for introducing a quantity of nitrogen gas into the interior of the bag without withdrawing any gas from the bag, and means for sealing the opening in the bag through which the nitrogen gas was introduced.

Both in the method and in the apparatus, preferably the gas permeable material of the bag is of a selective permeable material which is more permeable to oxygen than to nitrogen.

The invention includes control means for introducing the nitrogen gas into the sealed bag, with a gas outlet nozzle for positioning in the sealed bag, a gas line for connecting the nozzle to a source of gas, the gas line including a pressure regulator valve and a solenoid switch valve, and an electric power line for connecting the solenoid switch valve to an electric power source, the electric power line including a timer switch for activating the solenoid switch valve for a predetermined period of time.

In another form the apparatus of the invention for packaging perishable foods which are packed in a plurality of cartons, includes a cabinet adapted for mounting on a pallet, the cabinet having a plurality of interior storage spaces with access doors for said storage spaces, a first of the interior spaces including means for supporting a tank for gas under pressure, a reel of hose mounted in the first storage space above the tank, with means for connecting the tank outlet to one end of the hose, with the other end of the hose projecting out of the box, an outlet nozzle carried on the other end of the hose, a second of the interior spaces including means for supporting a roll of bags with a vertical axis, and an outlet slot in the cabinet for withdrawing bags from the roll within the box, a third of the interior storage spaces including means for supporting control means for controlling gas flow from the tank outlet to the nozzle, and an exposed shelf on the box having means for supporting a roll of self-adhesive tape.

An apparatus for treating perishable foods which are packed in a sealed bag, including a gas outlet nozzle for introducing gas into the sealed bag, a gas line for connecting the nozzle to a source of gas, the gas line including a pressure regulator valve and a solenoid switch valve, and an electric power line for connecting the solenoid switch valve to an electric power source, the electric power line including a timer switch for activating the solenoid switch valve for a predetermined period of time, means for supporting a tank for gas under pressure, the gas line including a reel of hose mounted adjacent the tank, with means for connecting the tank outlet to one end of the gas line, with the outlet nozzle carried on the other end of the line, means for supporting a roll of bags with a vertical axis, and control means for controlling gas flow from the tank outlet to the nozzle.

DESCRIPTION OF THE PREFERRED EMBODIMENTS

Figure 1:
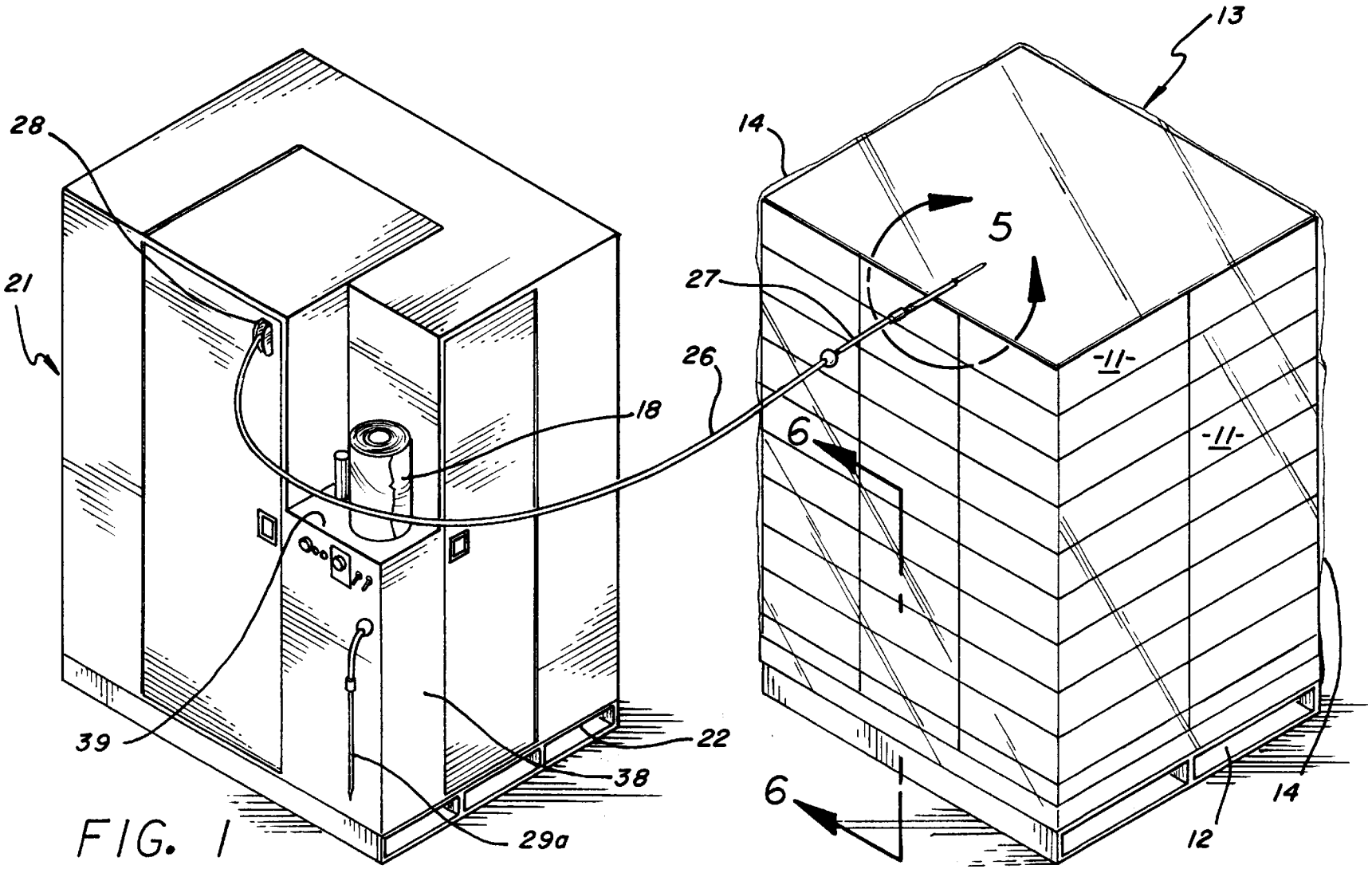
FIG. 1 is a perspective view illustrating a packaged stack of cartons and an apparatus incorporating the present preferred embodiment of the invention for introducing nitrogen gas into the stack.

In FIG. 1, a plurality of cartons 11 with a perishable food product, such as strawberries, packed therein, are stacked on a pallet 12 to form a carton stack 13. The carton stack 13 is covered by a bag 14 of a gas permeable material, with the bag having a closed top and sides and an open bottom.

Prior to placing the stack of cartons on the pallet, a bottom sheet 15, preferably of a plastic material such as linear molecular, low density polyethylene film (LLDPE), is placed on the top of the pallet, with overhanging sides 16. Typically the stack of cartons is the width and length of the pallet, and the edges of the bottom sheet overhang the pallet. Of course, where the stack of cartons is smaller than the pallet the sides 16 may rest on the pallet, while extending beyond the sides of the stack. Usually a cardboard top 17 is placed over the stack 13 in the field to protect the produce while in transit. The bag 14 will go over the top 17.

Figure 6:
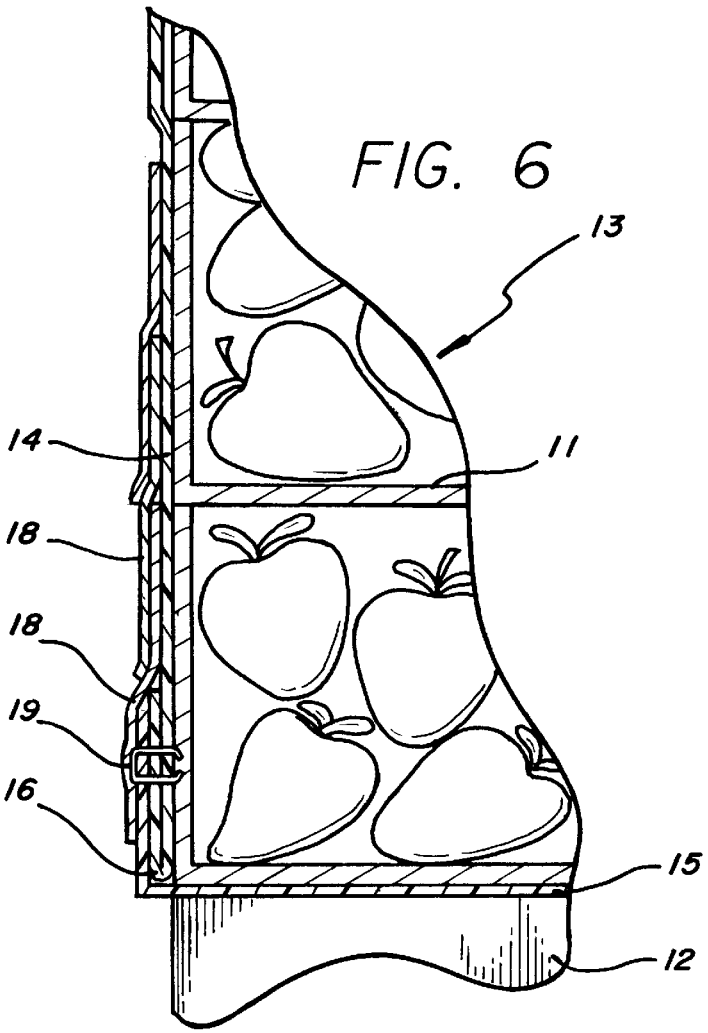
FIG. 6 is an enlarged partial sectional view taken along the line 6—6 of FIG. 1.
Figure 7:
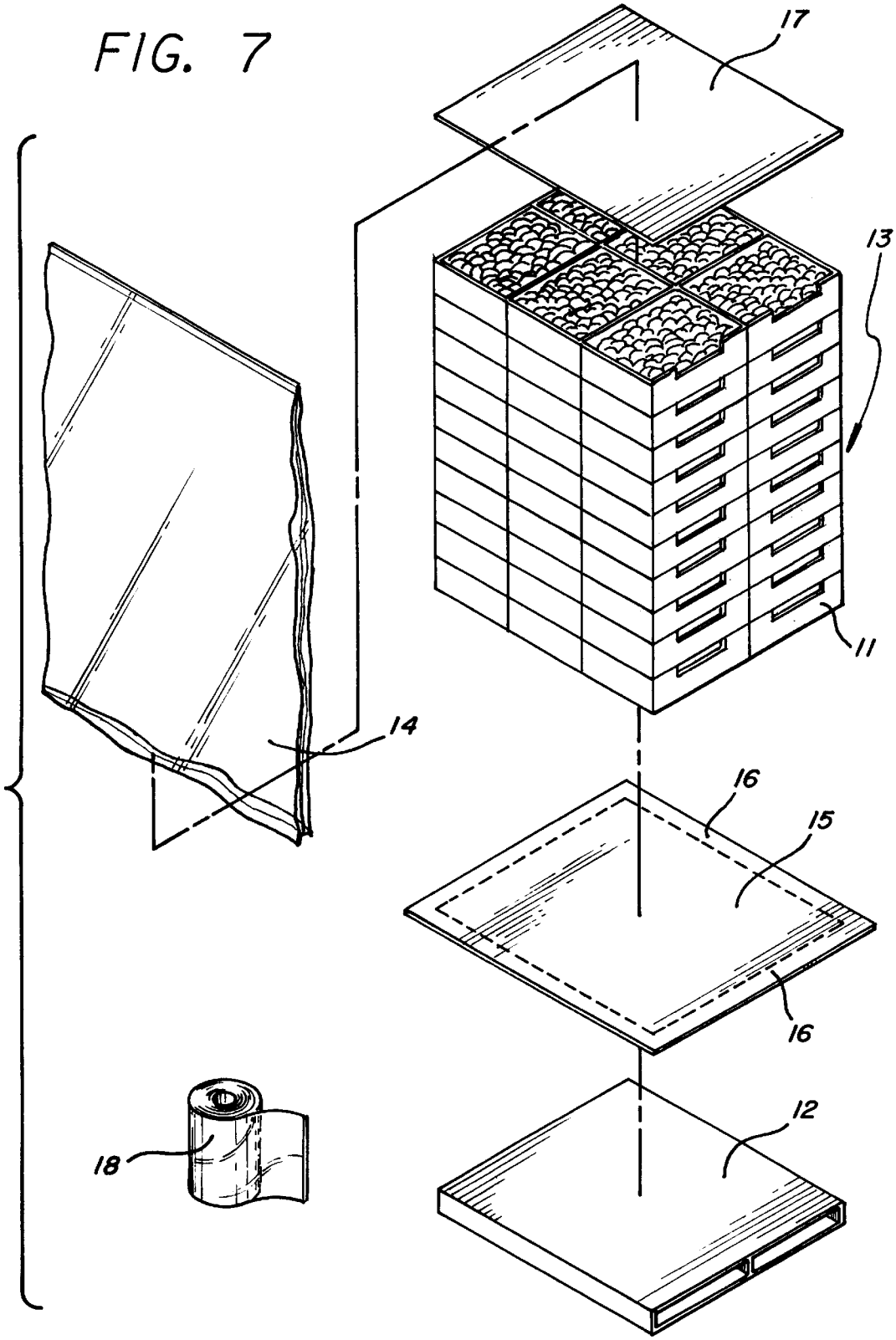
FIG. 7 is an exploded view of the stack of cartons of FIG. 1.

Next the edges of the bottom sheet 15 are sealed to the lower edges of the sides of the bag 14. Preferably this is accomplished by turning the lower edges of the bag upward and then turning the outer edges of the bottom sheet upward, overlying the edges of the bag, and joining them in place, such as by stapling at 19 shown in FIG. 6. Next the upturned edges of the bag and the bottom sheet may be sealed in place by wrapping with several layers of a self-adhesive tape 18.

Preferably, the gas permeable material of the bag is a selective permeable material which is more permeable to oxygen than to nitrogen. The presently preferred material for this purpose is LLDPE. Other suitable materials for this purpose are very low density polyethylene film (VLDPE). Preferably the ratio of the permeability to oxygen to the permeability to nitrogen for the material is in the range of about 2.8/1.0 to about 3.5/1.0. More preferably, the ratio is about 3.0/1.0 to about 3.3/1.0.

More specifically, using the absolute pressure method (ASTM D1434-66, "Gas Transmission Rate of Plastic Film and Sheeting") the preferred permeability of the film measured at 1 mil thickness, to oxygen is at least about 450 cc per 100 sq.in. per 24 hour period, and to nitrogen is at least about 140 cc per 100 sq.in. per 24 hour period. This is using a LLDPE film. The variance in permeability of the film at 1 mil can be as follows:

Oxygen—450 cc to 550 cc per 100 sq.in per 24 hrs.

Nitrogen—140 cc to 180 cc per 100 sq.in. per 24 hrs.

Carbon Dioxide—2300 cc to 2900 cc per 100 sq.in. per 24 hrs.

The ASTM gas transmission figures are expressed with regard to a 1 mil thickness, regardless of the actual thickness of the specific material being tested and reported.

Figure 2:
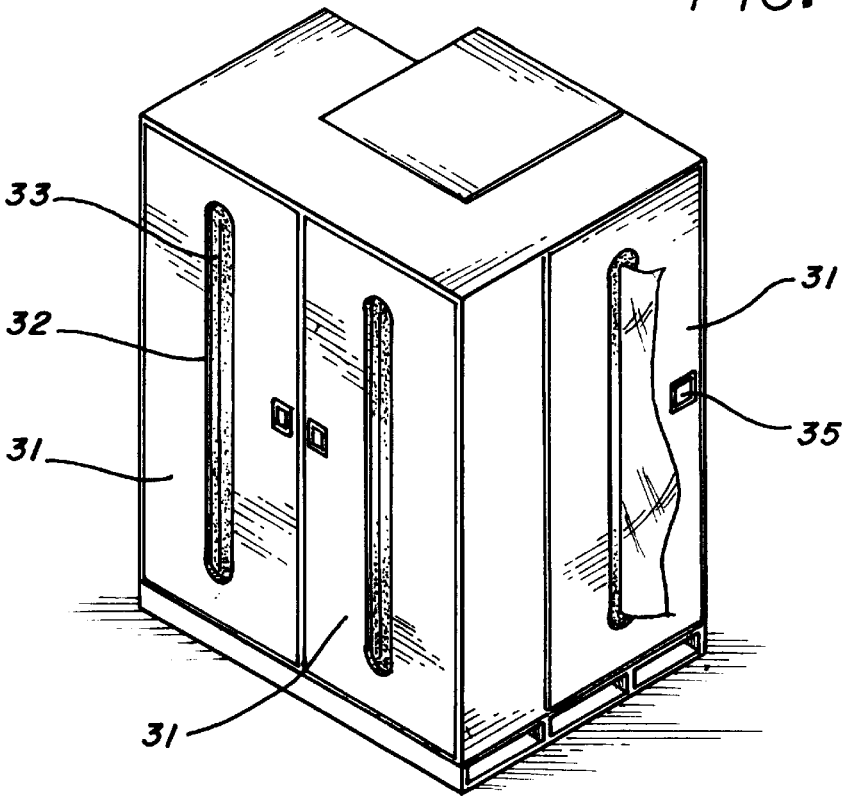
FIG. 2 is a perspective view of the apparatus of FIG. 1 taken from the opposite side.
Figure 3:
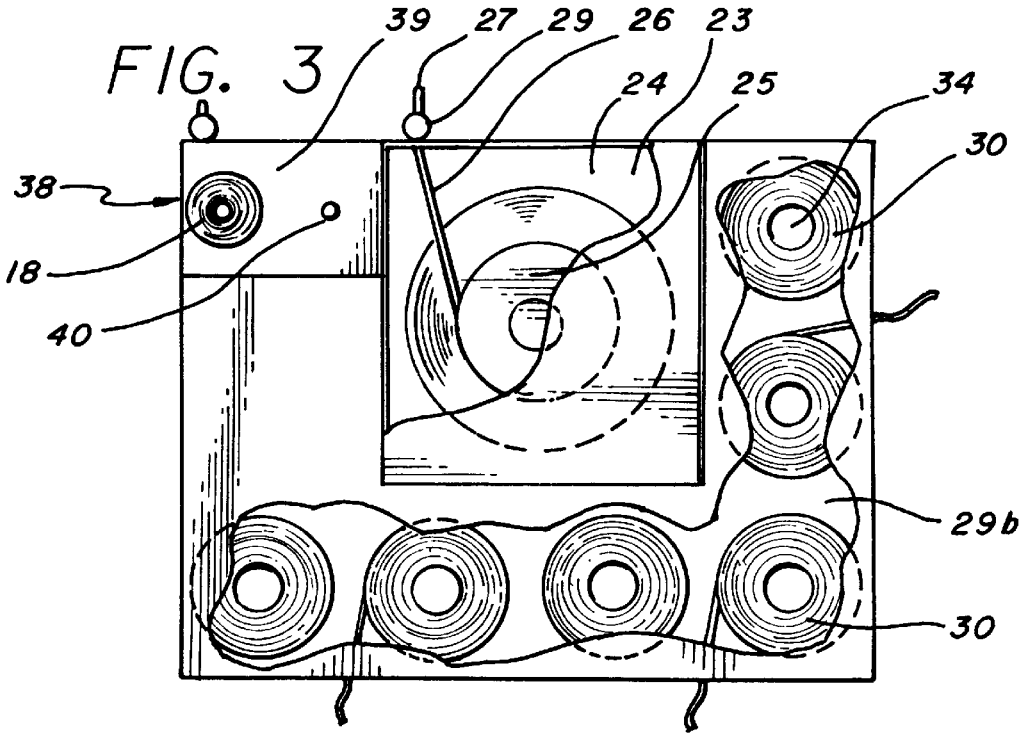
FIG. 3 is an enlarged top view of the apparatus of FIG. 2.

FIGS. 1, 2 and 3 illustrate the presently preferred embodiment of the apparatus for packaging perishable foods. A cabinet 21 has a plurality of interior storage spaces with access doors. The cabinet is adapted for mounting on a pallet 22 providing for portability and ease of transport of the cabinet.

In one interior space 23 of the cabinet, means are provided for supporting a tank 24 of the gas which is introduced into the sealed carton stack. A hose reel 25 is carried within the cabinet above the tank 24 and has a gas line 26 carried on the reel with the inner end of the line having a connector for connection to the gas tank, and with the outer end of the line having a nozzle 27 connected thereto. The gas line feeds out from the cabinet through an opening 28, and may have a stop member 29 adjacent the nozzle to prevent the hose line from being reeled into the cabinet. An electric line 29*a* provides for connection to an AC electric power source.

Another interior space 29*b* of the cabinet 21 provides for storage of a number of rolls 30 of the bags 14. In the embodiment illustrated, there are three access doors 31, with a vertical slot 32 with flexible fingers 33 providing closures for these slots. Each of the rolls 30 is supported on a vertical post 34, with a single bag fed out through a slot 32 from a roll positioned within side the cabinet. Preferably, each cabinet door 31 is hinged along one vertical side and has a latch 35 at the other side for opening and closing the door for changing and replacing rolls of bags.

Another interior space 38 of the cabinet projects only part way to the top of the cabinet, providing a shelf 39 with vertical posts 40 for supporting one of more of the rolls 18 of self adhesive material. The gas control equipment and the electrical control equipment are positioned within the space 38, with appropriate controls mounted on a vertical face of the cabinet for access by the operator.

Figure 4:
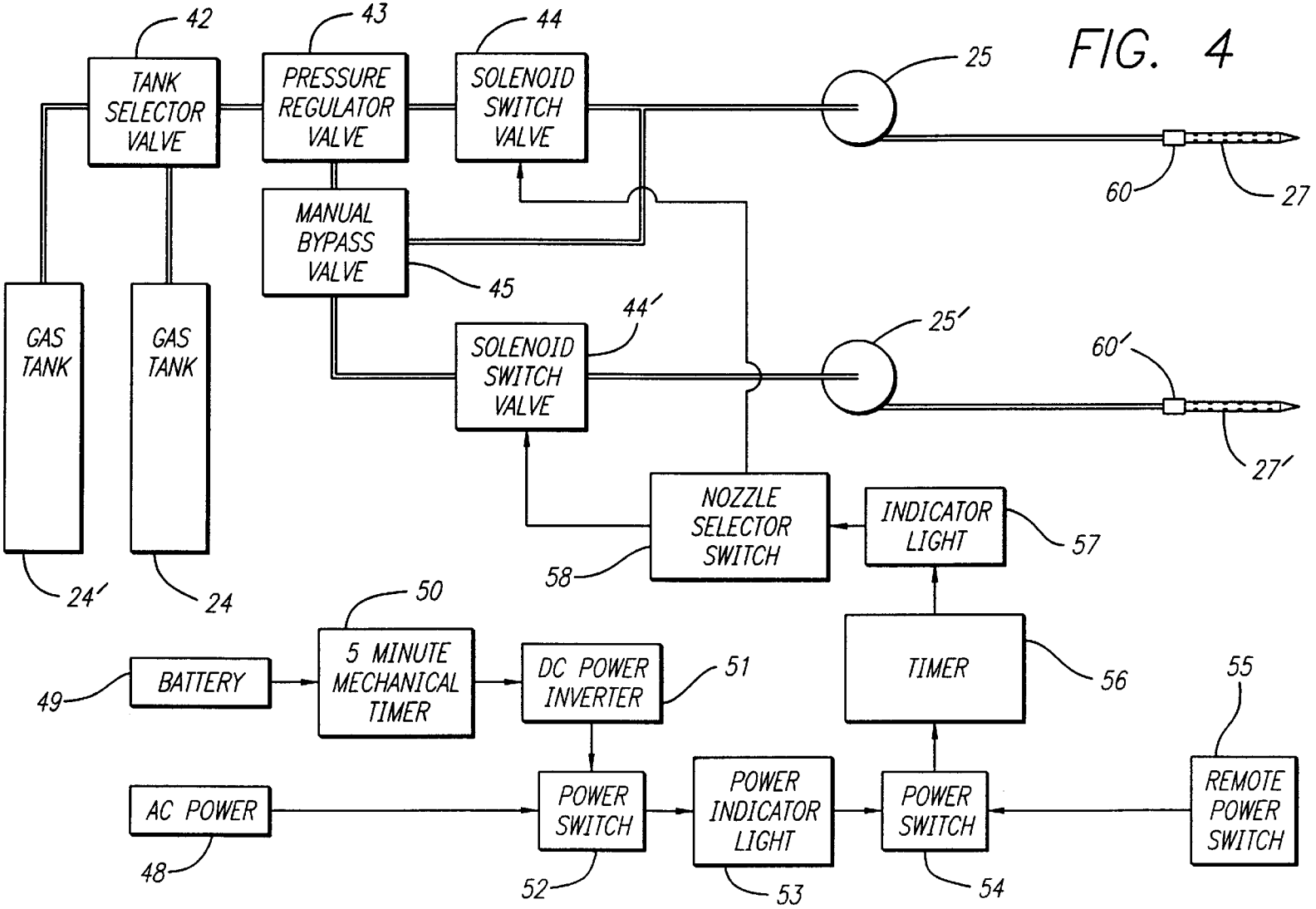
FIG. 4 is a gas and electric schematic of the apparatus of the invention.

The gas system and the electric system are shown in the schematic of FIG. 4. The gas supply line includes a tank selector valve 42, a pressure regulator valve 43, a solenoid switch valve 44, and a manual bypass valve 45. Desirably, one or more additional gas tanks 24' are utilized, so that the packaging operation does not have to be shut down when a tank of gas is exhausted. Also, if desired, two nozzles can be utilized and are shown in the diagram of FIG. 4 with a second solenoid switch valve 44', a second hose reel 25', and a second nozzle 27'.

The electric circuitry includes a DC power source utilizing 12 volt batteries 49, and an AC power source 48, as a stand by measure. The DC system includes a mechanical timer 50 to shut down DC power and prevent the batteries from being completely drained inadvertently. DC power can also be inverted into the AC through a power inverter 51 if the DC system was to fail. Ordinarily, the system operates solely on contained DC power, for portability of the machine. The power source, AC or DC, is selected by a switch 52, which also activates the power inverter.

The electrical system also includes a power indicator light 53 and a power switch 54 which may be mounted on the cabinet, a remote power switch 55 which may be positioned remote from the cabinet, a timer 56, and an indicator light 57 and a nozzle selector switch 58 which may be mounted on the cabinet. The indicator light 53 indicates to the operator that either the AC power or the battery is providing power to the system. The operator normally actuates the power switch 54 to energize the timer 56 to determine the length of time the solenoid switch valve is actuated to provide gas out through the nozzle. The indicator light 57 advises the operator that the system is on. The setting for the timer 56 can be adjusted to provide gas flow through the nozzle for the desired period of time. The nozzle selector switch 58 permits the operator to choose use of the nozzle 27 or the nozzle 27'. The manual by pass valve 45 can be used if there is a power failure or if the solenoid switch valve 44 does not operate. With this system, typically the operator will manually open the valve 45 and use a stop watch or other timer for providing gas flow through the nozzle for the desired period of time.

In another alternative mode of operation, a battery powered IR transmitter 60 can be positioned at the nozzle 27 for remote operation of a gas control valve, such as the solenoid switch valve 45 or a separate valve in the gas line.

Figure 5:
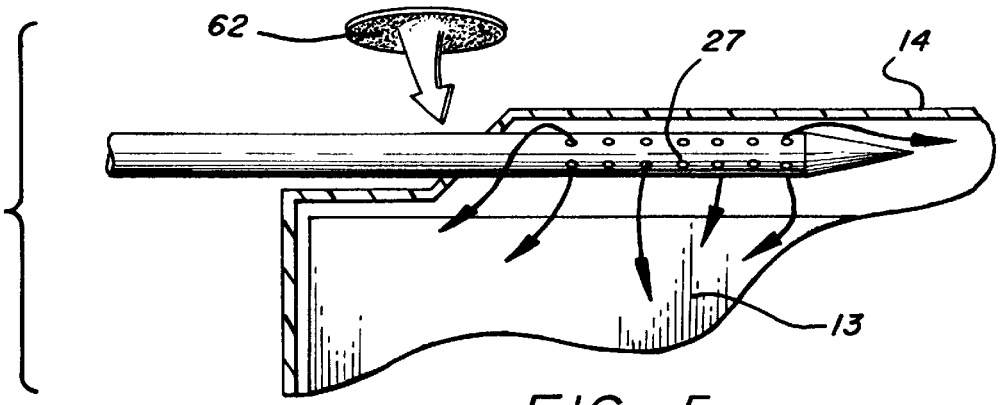
FIG. 5 is an enlarged partial sectional view taken in the circle 5—5 of FIG. 1.

In use, after the bag has been sealed to the bottom sheet, the operator inserts the nozzle 27 through the bag 14 into the interior of the stack, as shown in FIG. 5. Then the power switch 54 is actuated to energize the solenoid switch valve 44 through the timer 56, to provide gas under pressure through the pressure regulator 43 and the nozzle 27 into the interior of the bag. The pressure for the gas from the nozzle and the time for gas flow will depend on the condition of the product and the density of the packing. Desirably, the percentage of oxygen within the container is reduced by about 50% from about 20% oxygen to about 10% oxygen. Oxygen contained within the container can be measured from time to time by means of a gas analyzer. Preferably the gas flow is in the range of about 60 psi to about 130 psi and for a time of about 10 seconds to about 40 seconds. The most preferred flow rate and time is about 30 seconds at about 80 psi.

In the method and apparatus of the invention, high purity dry nitrogen gas is utilized.

In the invention, the nitrogen gas is introduced through an opening into the interior of the bag without withdrawing any gas from the bag, either prior to introducing the nitrogen gas, during the introduction of the nitrogen gas or following introduction of the nitrogen gas. The invention does not require nor utilize any withdrawal of any gas from the bag prior to introducing the nitrogen gas, and does not require any flushing of the interior of the bag prior to introduction of the nitrogen gas.

After the nitrogen gas has been introduced into the interior of the bag, the probe is withdrawn from the bag and the opening in the bag is sealed with a patch 62. This patch typically may be a self-adhesive material such as polyvinylchloride or polyethylene.

Thus it is seen that the objectives of the method and of the apparatus of the invention are achieved solely with the introduction of nitrogen gas.

There are several advantages to using nitrogen gas (N2). N2 has greater mass and is less permeable than oxygen and carbon dioxide making it ideal for displacing the oxygen within the package. It is also a tasteless gas which does not alter the taste of the fruit, unlike CO2 which can be detected as a "fizzy" taste when absorbed.

In the present invention several key things are accomplished which are not implemented in any presently known system. The main objective is to preserve and protect the fruit in an efficient manner, from the time that it is packaged in the cooling facility to the time that the seal of the package is broken at the marketplace. A number of things are done to accomplish this aim. First, implementing a portable, self contained machine, which in turn cuts labor and operating costs. Secondly, utilizing a multi-purpose plastic package to protect and preserve the packaged fruit. Next, using a "double seal" to contain the pressurized gas. Last, selecting a more effective type of gas for the preservation process, that does not affect the taste of the produce.

The apparatus of the invention was designed with ergonomics and efficiency as an aim. It is self contained with everything needed for the operator to perform the function of packaging the stack of cartons and have them ready for shipment. The apparatus is portable and may be taken to any location of the cooling facility, which eliminates having to transfer the packages to a designated room to be exhausted and recharged with gas, only to return them back to the holding room from which they came. Also, with the implementation of nitrogen verses CO2 , the air within the package no longer needs to be exhausted by the operator, which saves a considerable amount of time and energy. It is estimated that this invention saves 17%–24% on labor and operating costs to package the fruit.

As for the plastic film that is used in this invention, it is made of a linear molecular, low density polyethylene material. The linear chain of molecules in the plastic create a tighter bond in the material, making it less permeable with greater tensile strength than that of typical low density polyethylene film. This holds the N2 gas in the package for a longer period of time, allowing the fruit to consume the remaining O2 converting it into CO2 gas. The CO2 gas is then released through the permeability of the bag.

LLDPE is stronger than LDPE with a much higher elongation at break, and greater elasticity at cold temperatures. The film is exceptioned for resistance to tearing. Often with LDPE the tabs of the bottom sheets are torn while loading and unloading produce coming in from the field. When this happens, the package can no longer be sealed. Also with LDPE, seal breakage can occur by packages chafing in transit. LLDPE virtually eliminates these problems.

Another difference in the packaging material used is the thickness of the plastic. With LLDPE, a heavier plastic is used for quality assurance strength on the bottom sheet and for insulation purposes of the bag. Conventional systems use a film thickness of about 1.5 mils; the system of the invention uses a film preferably of a thickness of about 3.0–4.0 mils.

Quite often various types of produce are transported within the same trailer and the temperatures may vary from below freezing to as high as fifty degrees Fahrenheit, depending on the type of produce. The thicker plastic film protects delicate fruit, like strawberries, from exposure to fluctuating temperatures and wind chill created by the refrigeration unit, insulating the fruit from being exposed to these harsh conditions.

In the process of the invention, the package is sealed twice; hence, the "double seal". When the edge of the bag overlays the tabs of the bottom sheet, the bag is then pulled taunt, with the excess being folded into the pallet and stapled, like a "hospital corner" in the process of making one's bed. The tabs are then folded up over the bag, and stapled to the bottom cartons, forming the first seal. Next, a roll of self adhesive film, a minimum of 12 inches wide, is used to wrap around the pallet completely covering the first seal, creating a second seal. Other processes simply tape the tabs against the edge of the bag, and often leak due to poor alignment.

An important feature of the invention is the use of nitrogen gas (N2). When injected into the package, N2 displaces the oxygen within the package. The O2 level desirably is brought from about 20% at atmospheric pressure down to an average of 10%. The oxygen which remains is either consumed by the respiration process of the fruit, converting it to CO2 gas or else forced out of the package through the permeability of the plastic. The package is three times more permeable to oxygen that it is to nitrogen, hence the nitrogen stays in the package. Nitrogen is also a tasteless gas that does not leave a residue on the fruit when injected into the package, nor create a "champagne" or "fizzy" taste in the fruit.

In conclusion the present invention will be a great improvement for the entire fruit industry, especially strawberries: an ergonomically efficient machine, that preserves a fresh product being transported to a distant marketplace, arriving in outstanding condition.

I claim:

1. In a method of packaging fresh perishable foods wherein the perishable food product is packed in a plurality of cartons and the cartons are stacked on a pallet for storage and/or transportation, the method including the steps of:

placing a sheet of flexible plastic material on a pallet to provide a bottom sheet, the bottom sheet having outer edges extending beyond the sides of the stack and overhanging the perimeter of the pallet;

stacking a plurality of cartons on the bottom sheet on the pallet to form a carton stack;

covering the top and sides of the carton stack with a flexible bag made of a gas permeable material, the bag having a closed top and an open bottom with a lower edge overhanging the perimeter of the pallet;

overlaying the lower edge of the bag and the outer edges of the bottom sheet;

folding the overlaid lower edge of the bag and the outer edges of the bottom sheet upward against the bag, whereby forming a first seal;

introducing a quantity of nitrogen gas through an opening into the interior of the bag without withdrawing any gas from the bag; and sealing the opening to retain the nitrogen within the bag.

2. The method as defined in claim 1 including using as the gas permeable material, a selective permeable material which is more permeable to oxygen than to nitrogen.

3. The method as defined in claim 2 wherein the selective permeable material is a material selected from the group consisting of linear molecular low density polyethylene film and very low density polyethylene film.

4. The method as defined in claim 2 wherein the selective permeable material is a linear molecular low density polyethyne film.

5. The method as defined in claim 2 wherein the ratio of the permeability to oxygen to the permeability to nitrogen is in the range of about 2.8 to 1.0 to about 3.5 to 1.0.

6. The method as defined in claim 2 wherein the ratio of the permeability to oxygen to the permeability to nitrogen is in the range of about 3.0 to 1.0 to about 3.3 to 1.0.

7. The method as defined in claim 2 further comprising:

stapling the folded overlaid edges to the cartons; and wrapping a strip of a self adhesive film around the upright ends of the folded overlaid edges, whereby forming a second seal.

8. The method as defined in claim 5 including introducing the nitrogen gas at a pressure in the range of about 60 psi to about 130 psi for a time in the range of about 10 seconds to about 40 seconds.

9. The method as defined in claim 5 including introducing the nitrogen gas at a pressure of about 80 psi for a time of about 30 seconds.

10. The method as defined in claim 1 further comprising:

stapling the folded overlaid edges to the cartons; and wrapping a strip of a self adhesive film around the upright ends of the folded overlaid edges, whereby forming a second seal.

11. The method as defined in claim 10 including introducing the nitrogen gas at a pressure in the range of about 60 psi to about 130 psi for a time in the range of about 10 seconds to about 40 seconds.

12. The method as defined in claim 9 including introducing the nitrogen gas at a pressure of about 80 psi for a time of about 30 seconds.

13. The method as defined in claim 12 wherein the thickness of the gas permeable material is about 3.0–4.0 mils and permeability of the film to oxygen, nitrogen and carbon dioxide is in the range of Oxygen—450 cc to 550 cc per 100 sq.in per 24 hrs.

Nitrogen—140 cc to 180 cc per 100 sq.in. per 24 hrs.

Carbon Dioxide—2300 cc to 2900 cc per 100 sq.in. per 24 hrs.

14. The method as defined in claim 13 wherein the thickness of the gas permeable material is about 3.0–4.0 mils and the permeability of the film to oxygen is at least about 450 cc per 100 sg. in. per 24 hours and the permeability of the film to nitrogen is at least about 140 cc per 100 sq. in. per 24 hours.

15. The method as defined in claim 2 wherein the thickness of the gas permeable material is about 3.0–4.0 mils and permeability of the film to oxygen, nitrogen and carbon dioxide is in the range of Oxygen—450 cc to 550 cc per 100 sq.in per 24 hrs.

Nitrogen—140 cc to 180 cc per 100 sq.in. per 24 hrs.

Carbon Dioxide—2300 cc to 2900 cc per 100 sq.in. per 24 hrs.

16. The method as defined in claim 1 wherein the thickness of the gas permeable material is about 3.0–4.0 mils and the permeability of the film to oxygen is at least about 450 cc per 100 sg. in. per 24 hours and the permeability of the film to nitrogen is at least about 140 cc per 100 sq. in. per 24 hours.

* * * * *